US005733637A

United States Patent [19]

Moriya et al.

[11] Patent Number: 5,733,637

[45] Date of Patent: Mar. 31, 1998

[54] RECORDING MEDIUM, IMAGE FORMING METHOD USING THE SAME AND PRINTED PRODUCT

[75] Inventors: Kenichi Moriya, Tokyo; Shinichi Tochihara, Hadano; Masato Katayama, Yokohama; Masahiko Higuma, Tougane; Yuko Nishioka, Tokyo, all of Japan

[73] Assignee: Canon Kabushiki Kaisha, Tokyo, Japan

[21] Appl. No.: 682,290

[22] Filed: Jul. 17, 1996

[30] Foreign Application Priority Data

| | | | |
|---|---|---|---|
| Jul. 21, 1995 | [JP] | Japan | 7-185859 |
| Oct. 17, 1995 | [JP] | Japan | 7-268295 |
| Jun. 10, 1996 | [JP] | Japan | 8-147087 |

[51] Int. Cl.[6] ..... B41M 5/00; B41J 2/01

[52] U.S. Cl. ..... 428/207; 347/56; 347/105; 428/206; 428/328; 428/500

[58] Field of Search ..... 347/56, 105, 106; 428/195, 206, 207, 328, 500

[56] References Cited

U.S. PATENT DOCUMENTS

| | | | |
|---|---|---|---|
| 4,780,356 | 10/1988 | Otouma et al. | 428/212 |
| 4,785,313 | 11/1988 | Higuma et al. | 346/135.1 |
| 4,832,984 | 5/1989 | Hasegawa et al. | 427/161 |
| 4,877,680 | 10/1989 | Sakaki et al. | 428/332 |
| 4,879,166 | 11/1989 | Misuda et al. | 428/212 |
| 4,954,395 | 9/1990 | Hasegawa et al. | 428/318.4 |
| 5,027,131 | 6/1991 | Hasegawa et al. | 346/1.1 |
| 5,059,983 | 10/1991 | Higuma et al. | 346/1.1 |
| 5,101,218 | 3/1992 | Sakaki et al. | 346/1.1 |
| 5,104,730 | 4/1992 | Misuda et al. | 428/304.4 |
| 5,120,601 | 6/1992 | Kotaki et al. | 428/327 |
| 5,139,868 | 8/1992 | Mori et al. | 428/327 |
| 5,171,626 | 12/1992 | Nagamine et al. | 428/212 |
| 5,182,175 | 1/1993 | Sakaki et al. | 428/537.5 |
| 5,266,383 | 11/1993 | Sakaki et al. | 428/195 |
| 5,472,773 | 12/1995 | Misuda et al. | 428/195 |
| 5,635,291 | 6/1997 | Yoshino et al. | 428/304.4 |

FOREIGN PATENT DOCUMENTS

| | | |
|---|---|---|
| 0672539 | 9/1995 | European Pat. Off. . |
| 54-59936 | 5/1979 | Japan . |
| 55-146786 | 11/1980 | Japan . |
| 57-102391 | 6/1982 | Japan . |
| 58-89391 | 5/1983 | Japan . |
| 60-220750 | 11/1985 | Japan . |
| 63-115779 | 5/1988 | Japan . |
| 63-221077 | 9/1988 | Japan . |
| 4-67986 | 3/1992 | Japan . |
| 4-320877 | 11/1992 | Japan . |
| 5-221112 | 8/1993 | Japan . |
| 5-262028 | 10/1993 | Japan . |
| 5-309956 | 11/1993 | Japan . |
| 7-1828 | 1/1995 | Japan . |

OTHER PUBLICATIONS

Patent Abstracts of Japan, vol. 96, No. 7, Jul. 31, 1996 with respect to JP-08-060099 of Mar. 5, 1996.

*Primary Examiner*—Pamela R. Schwartz

*Attorney, Agent, or Firm*—Fitzpatrick, Cella, Harper & Scinto

[57] ABSTRACT

A recording medium has an ink receiving layer provided on a substrate and containing (A) polyvinyl acetal resin and (B) alumina hydrate at a ratio A/B within the range of 50/1 to 6/4.

20 Claims, No Drawings

RECORDING MEDIUM, IMAGE FORMING METHOD USING THE SAME AND PRINTED PRODUCT

BACKGROUND OF THE INVENTION

1. Field of the Invention

The present invention relates to a recording medium suitably used for ink jet recording, an image forming method using the recording medium and a printed product formed thereby.

2. Related Art

In an ink jet printing system, ink droplets are generated and ejected by any one of various ink ejecting methods such as an electrostatic attraction method, a method using a piezoelectric element for applying mechanical vibration or displacement to an ink, and a method employing the pressure of bubbles generated by heating an ink, so that a part or all of the ink droplets are adhered to a recording medium such as paper or a plastic film coated with an ink receiving layer to record an image thereon. This printing system attracts attention as a system which generates less noise and which permits high-speed printing and multi-color printing.

An ink containing water as a main component is mainly used as the ink for ink jet printing systems due to its safety and recording characteristics, and polyhydric alcohols are frequently added to the ink in order to prevent nozzle clogging and improve ejection stability.

Examples of conventional recording media used for ink jet printing include a recording medium comprising a porous ink receiving layer mainly consisting of an inorganic pigment such as silica, and a recording medium comprising a nonporous ink receiving layer mainly consisting of a resin so as to absorb ink by the swelling action of the resin. A nonporous ink receiving layer has the advantages that it has excellent transparency (clearness) and a high ink absorption capacity even if it is thin, and that since it does not yellow, the recording medium has excellent storage properties, as compared with a porous ink receiving layer. A nonporous receiving layer thus permits the production of OHP (Over Head Projector) sheets and glossy film at low cost.

Conventional recording media comprising the ink receiving layer mainly consisting of a resin include a recording sheet comprising an ink receiving layer consisting of acetal-modified polyvinyl alcohol, as disclosed in Japanese Patent Laid-Open Nos. 63-221077, 5-2211122, 5-262028 and 7-1828; a recording sheet comprising polyvinyl alcohol and polyvinyl pyrrolidone, as disclosed in Japanese Patent Laid-Open No. 55-146786; a recording sheet mainly comprising polyvinyl pyrrolidone, as disclosed in Japanese Patent Publication No. 3-29596; a recording sheet comprising polyvinyl alcohol and polyvinyl butyral, as disclosed in Japanese Patent Laid-Open No. 57-102391; a recording sheet comprising a crosslinked water-soluble resin, as disclosed in Japanese Patent Laid-Open No. 58-89391; a recording sheet comprising a polyester resin and having excellent resistance to fingerprint marks, as disclosed in Japanese Patent Laid-Open No. 5-309956; a recording sheet comprising an ink receiving layer mainly consisting of alumina sol, as disclosed in Japanese Patent Laid-Open No. 4-67986; and a recording sheet for an over head projector comprising a polyester film and a hydrophilic film provided on the polyester film and comprising water-soluble polyvinyl alcohol having a degree of saponification of 70 to 90%.

Recent improvements in the performance of ink jet recording apparatus, such as increased recording speed and realization of multicolor recording, have brought about the need for the ink jet recording medium to have a wide variety of high-performance characteristics.

Namely, the recording medium is required to have the following characteristics:

(1) High ink absorbing power (high absorption capacity and high absorption speed);

(2) The ability to form dots with high optical density and clear peripheries;

(3) The ability to form substantially circular dots having smooth peripheries;

(4) Less change in printing characteristics and the prevention of curling due to changes in temperature and humidity;

(5) Anti-blocking property;

(6) The ability to stably maintain an image without deterioration in long-term storage (particularly, in an environment of high temperature and humidity);

(7) Stability and the prevention of deterioration in long-term storage (particularly, in an environment of high temperature and humidity);

(8) Resistance to fingerprint marks;

(9) Excellent water resistance of the ink receiving layer and the printed portion; and

(10) Excellent adhesion between the ink receiving layer and the substrate.

It is also required that an OHP recording sheet further have excellent transparency, i.e., not only the film substrate but also the ink receiving layer must have excellent transparency.

On the other hand, for white substrates such as a white film or resin-coated paper, the ink receiving layer is also required to have excellent transparency in order to prevent deterioration in whiteness and glossiness. Particularly, in regard to glossiness, not only the unprinted portion but also the printed portion are required to have high glossiness.

These characteristics have a trade-off relationship, and conventional known technology cannot simultaneously satisfy all these characteristics.

Further, increases in recording speed and image density and progress in color printing cause the critical problem that image quality deteriorates due to poor ink fixing.

As an example of a conventional recording medium, the recording sheet disclosed in Japanese Patent Publication No. 3-29596, which comprises an ink receiving layer mainly comprising polyvinyl pyrrolidone, has relatively good ink absorbing power at room temperature and normal humidity, but ink dries very slowly at a high temperature and at high humidity. This tends to cause blocking between prints. The recording sheet also has the fault that the recording surface has low mechanical strength and is thus easily damaged.

The recording sheet disclosed in Japanese Patent Laid-Open No. 55-146786 which comprises an ink receiving layer comprising polyvinyl alcohol and polyvinyl pyrrolidone has good ink absorption and fixing properties, but it has the fault that the ink receiving layer lacks water resistance and is thus easily peeled off when splashed with water.

The recording sheet disclosed in Japanese Patent Laid-Open No. 57-102391 which comprises an ink receiving layer comprising polyvinyl alcohol and polyvinyl butyral has the faults that the ink receiving layer has poor compatibility between the two resins and that it has very low transparency.

The recording sheet disclosed in Japanese Patent Laid-Open No. 60-220750 which comprises an ink receiving layer mainly comprising polyvinyl alcohol is excellent in anti-blocking property and mechanical strength of the recording surface, but the recording sheet has the problems that, when the recording sheet is allowed to stand in an environment of high temperature and high humidity for a long time, it deteriorates, and that, when an image is allowed to stand in an environment of high temperature and high humidity for a long time, dots are blurred, and the image definition thus deteriorates.

The recording sheet proposed in Japanese Patent Laid-Open No. 58-89391 which comprises an ink receiving layer formed by crosslinking a water-soluble resin has excellent water resistance, but it has the fault of poor ink absorption.

The recording sheet disclosed in Japanese Patent Laid-Open No. 5-309956 which mainly comprises a polyester resin has the excellent resistance to fingerprint marks, but it has fault that other properties such as ink receiving and image storage properties are very poor. The recording sheet is thus unsatisfactory.

The problems of ink absorption and water resistance are solved to some extent by using polyvinyl acetal for the ink receiving layer, as disclosed in Japanese Patent Laid-Open Nos. 63-221077, 5-221112, 5-262028 and 7-1828. However, particularly when a printed image is allowed to stand in an environment of high temperature and high humidity for a long time, the image definition is not satisfactorily maintained. In addition, in a printed portion having a high printing density, ink is not sufficiently absorbed, thereby causing beading (the phenomenon wherein ink droplets partly collect to form beads of ink on the printing surface, resulting in observable nonuniformity in density). Even if the recording sheet absorbs an ink, much time is required for fixing and drying the ink absorbed. The recording sheet is thus unsatisfactory.

The recording sheet disclosed in Japanese Patent Laid-Open Nos. 4-67986 and 4-320877, which comprises an ink receiving layer mainly consisting of alumina hydrate, is satisfactory in ink absorption and anti-blocking property, but it has the fault that other properties such as ink absorption capacity, curling, transparency, storage properties, etc. are poor. The recording sheet is thus unsatisfactory.

SUMMARY OF THE INVENTION

Accordingly, an object of the present invention is to provide a recording medium which simultaneously has the above-mentioned characteristics, an ink jet recording method using the medium and a printed product obtained by the recording method. Particularly, an object of the present invention is to provide a recording medium which is excellent in water resistance, resistance to fingerprint marks, ink absorption capacity, ink fixing properties, adhesion between the ink receiving layer and the substrate and water resistance of the recorded portion, which is significantly excellent in transparency of the ink receiving layer when a transparent substrate is used, which is excellent in glossiness when a white substrate is used, and which causes no deterioration in image quality or the recording medium itself even when a recorded image is allowed to stand in an environment of high temperature and high humidity for a long time. Other objects of the invention are to provide an image forming method using the recording medium, and a printed product obtained thereby.

In accordance with one aspect of the present invention, there is provided a recording medium comprising a substrate and an ink receiving layer provided on at least one side of the substrate, wherein the ink receiving layer contains (A) polyvinyl acetal resin and (B) alumina hydrate at a ratio A/B by weight within the range of 50/1 to 6/4.

In another aspect of the present invention, there is provided an image forming method comprising applying an ink to the recording medium by using an ink jet recording method.

In a further aspect of the present invention, there is provided a printed product obtained by forming an image on the recording medium.

DETAILED DESCRIPTION OF THE PREFERRED EMBODIMENTS

In development of a recording sheet suitable for ink jet recording, and a transparency film for an over head projector, the inventors found that a recording medium coated with the above-described composition has very excellent performance with respect to ink absorption capacity, ink fixing properties, image storage properties, and resistance to fingerprint marks, exhibits definition and sharpness of dots and excellent image quality, causes less change in performance due to changes in environmental conditions such as temperature and humidity, and is stable in long-term storage, particularly, in an environment of high temperature and high humidity (storage properties of the recording medium). The recording medium also permits the formation of an image which is stable in long-term storage in an environment of high temperature and high humidity (image storage properties), exhibits excellent transparency and OHP suitability when a transparent substrate is used, causes no problem such as deterioration in whiteness and glossiness when a white substrate such as a white film or resin-coated paper is used, and enables the realization of a printed portion having high glossiness. The present invention has been achieved on the basis of these findings.

The present invention is described in further detail below with reference to preferred embodiments.

The polyvinyl acetal resin used as a first compound in the present invention represents an addition and/or condensation reaction product of polyvinyl alcohol (referred to as "PVA" hereinafter). The addition and/or condensation reaction product of PVA represents the product obtained by addition and/or condensation reaction of PVA and a compound having reactivity to the hydroxyl groups of PVA. The polyvinyl acetal resin may be an aromatic polyvinyl acetal resin.

Examples of the compounds having reactivity to the hydroxyl groups of PVA include aldehyde compounds, carboxyl compounds, epoxy compounds, isocyanate compounds, acid anhydrides, N-methylol compounds, activated vinyl compounds, multivalent metallic compounds and the like. The addition and/or condensation reactions of such compounds and PVA are already known.

The PVA used in the present invention can be obtained by acid or alkali saponification of a vinyl acetate polymer or a copolymer of vinyl acetate and another copolymerizable monomer such as ethylene, propylene, vinyl chloride, (meth)acrylic acid or an ester thereof. The degree of saponification of the thus-obtained PVA is preferably about 75 to 99%, and the degree of polymerization of the PVA is preferably 500 to 3500. However, the degrees of saponification and polymerization are not limited to the above preferred ranges. Various types of PVA having the above degrees of saponification and polymerization can be used singly or in combination. PVA modified with various modifiers during production of the raw material or after saponification, for example, cation-modified PVA, anion-modified PVA, and the like, may be used.

Although the foregoing compounds can be used as compounds for the addition and/or condensation reaction of PVA, aldehyde compounds are particularly preferable. Examples of such aldehyde compounds include aliphatic saturated aldehydes such as formaldehyde, acetaldehyde, propionaldehyde, butyl aldehyde, isobutyl aldehyde, isopropyl aldehyde, valeraldehyde, isovaleraldehyde and the like; aromatic aldehydes such as benzaldehyde, o-, m- or p-tolualdehyde, benzyl aldehyde, salicylaldehyde, cinnamaldehyde, α- or β-naphthoaldehyde and the like; heterocyclic aldehydes such as furfural and the like; aliphatic unsaturated aldehydes such as acrolein, crotonaldehyde, propiolaldehyde, hexenal, heptenal and the like; aliphatic dialdehydes such as glyoxal, succindialdehyde, glutaraldehyde, adipodialdehyde, piperine dialdehyde, suberine dialdehyde, sebacine dialdehyde, and the like.

Of these aldehydes, aliphatic aldehydes such as isobutyl aldehyde, isopropyl aldehyde, n-butyl aldehyde and the like; aromatic aldehydes such as benzaldehyde, benzyl aldehyde, phenylacetaldehyde and the like are particularly preferable.

The polyvinyl acetal resin has good performance with respect to the water resistance of the ink receiving layer and the printed portion, and the transparency of the ink receiving layer. In consideration of ease of industrial synthesis and production cost, benzaldehyde, phenylacetaldehyde and n-butyl aldehyde are the most preferable aldehydes.

The degree of modification of the PVA with a compound having reactivity to the hydroxyl groups of PVA, i.e., degree of acetalization, depends upon the degree of saponification of the PVA, the degree of polymerization of the PVA, the degrees of hydrophilic nature and hydrophobic nature of the PVA and modifier used, and the required performance of a recording material. However, the degree of modification is a degree which does not cause excessive loss of the hydrophilic nature of the modified PVA, i.e., 0.5 to 40 mol %, preferably 3 to 25 mol %, and more preferably 5 to 20 mol %. With a degree of modification of less than 0.5 mol %, the effect of improving performance is insufficient, as compared with unmodified PVA. With a degree of over 40 mol %, the ink receiving layer has good water resistance, but ink absorption deteriorates.

In view of the adhesion of the ink receiving layer to the substrate, and in view of the water resistance of the ink receiving layer, the ratio of the hydroxyl groups of the polyvinyl acetal resin obtained by reaction of the hydroxyl groups of PVA and an aldehyde compound is preferably 10 mol % to 60 mol %, and more preferably 30 to 50 mol %. Namely, when the ratio of hydroxyl groups is less than 10 mol %, the adhesion to the substrate, particularly, the adhesion to a high-polarity material such as glass, metal, plastic or wood, deteriorates, and when the ratio exceeds 60 mol %, the water resistance of the ink receiving layer itself deteriorates.

Examples of the alumina hydrate used as a second compound in the present invention include gibbsite, bayerite, nordstrandite, boehmite, pseudo-boehmite, diaspore, amorphous alumina hydrate and the like.

From the viewpoints of dyeing and fixing properties of a dye, and transparency in film formation, boehmite, pseudo-boehmite (AlO(OH)) and amorphous alumina hydrate are preferable as the alumina hydrate used in the present invention. The particle size of the alumina hydrate is preferably 1.0 to 80.0 nm, and, when a layer is formed by using a single alumina hydrate, the pore size is preferably 2.0 to 20.0 nm.

The content ratio (A/B) by weight of polyvinyl acetal resin (A) to alumina hydrate (B) contained in the ink receiving layer is preferably 50/1 to 6/4, and more preferably 30/1 to 7/3. When the ratio (A/B) of the polyvinyl acetal resin exceeds 50/1, no effect can be obtained from adding the alumina hydrate, and, particularly, the effects of improving the resistance to fingerprint marks, ink fixing properties, image storage properties, and glossiness when using a white substrate are insufficient.

When the ratio A/B is lower than 3/2, i.e., when the content of the alumina hydrate is high, since the amount of the acetal resin available for ink absorption is decreased, the ink absorption deteriorates. This causes significant nonuniformity in a solid image and boundary feathering between different colors. The requirements of ink fixing properties and clearness therefore are not sufficiently satisfied.

When a transparent substrate is used, the recording medium of the present invention preferably exhibits a haze of not more than 10%, more preferably not more than 5%. When a white substrate is used, after the ink receiving layer is provided, the rate of reduction in glossiness is preferably not more than 20%, more preferably not more than 10%.

It is preferable for improving the image storage properties that the ink receiving layer of the recording medium further contains a cationic compound.

Any cationic compounds containing cationic portions in their molecules may be used. Examples of such cationic compounds include tertiary ammonium salt type cationic surfactants such as monoalkylammonium chloride, dialkylammonium chloride, tetramethylammonim chloride, trimethylammonium chloride, ethylene oxide-added ammonium chloride and the like; amine type cationic surfactants, and ampholytic surfactants such as alkyl betaine, imidazolinium betaine, alanine and the like, which contain cationic portions.

It is particularly preferable to use a cationic resin as the cationic compound. Although the cationic resin is not limited as long as it contains a cationic portion in the molecule thereof, when an image is recorded on the ink receiving layer containing a cationic compound by using an ink containing a dye, the water resistance and image density of the recorded image are improved, but light resistance tends to deteriorate. Therefore, in order to obtain satisfactory image water resistance and image density by adding the cationic resin in an amount as small as possible, it is preferable to use a cationic resin having a weight average molecular weight of 500 to 50000, and preferably 1000 to 10000. When the weight average molecular weight is less than 500, the recorded image has insufficient water resistance. When the weight average molecular weight exceeds 50000, the efficiency of bonding to a dye molecule tends to deteriorate due to molecular structural steric hindrance, and the addition of a small amount of cationic resin has only a small effect.

Examples of cationic resins include cation-modified polyacrylamide, copolymers of acrylamide and a cationic monomer, polyacrylamine, polyaminesulfone, polyvinylamine, polyethyleneimine, polyamide epichlorohydrin resins, polyvinyl pyridinium halides and the like. Other examples of such cationic resins include copolymers of vinylpyrrolidone monomer and other general monomers, copolymers of vinyloxazolidone monomer and other general monomers, copolymers of vinylimidazole monomer and other general monomers and the like.

Although the foregoing cationic resins are preferably used, these resins can be used singly or in a mixture of a plurality of resins, and, of course, the cationic resin is not limited to these resins.

When polyvinyl acetal resin (A) and cationic compound (C) are mixed, the content ratio A/C by weight is 2O preferably 190/1 to 19/1. When the ratio A/C by weight is higher than 190/1, the water resistance of the recorded image and the long-term storage properties of the recorded image in an environment of high temperature and high humidity are not sufficiently improved. When the cationic compound (C) is used at a ratio A/C lower than 19/1, ink absorption and uniformity of a solid image deteriorates, feathering easily occurs at boundaries between different colors, and ink fixing properties are also liable to deteriorate.

The ink receiving layer may further contain a crosslinking agent such as methylol melamine, methylol urea, methylol hydroxypropylene urea, isocyanate or the like. However, the crosslinking agent is not limited to these compounds.

The composition of the ink receiving layer may further contain one of various fillers and additives within a range which does not hinder the achievement of the objects of the present invention.

Examples of fillers include silica, aluminum silicate, magnesium silicate, basic magnesium carbonate, talc, clay, hydrotalcite, calcium carbonate, titanium oxide, zinc oxide, and plastic pigments such as polyethylene, polystyrene, polyacrylate and the like.

Examples of additives include various surfactants, antifoaming agents, antioxidants, fluorescent brighteners, ultraviolet absorbers, dispersants, viscosity modifiers, pH adjustors, mildewcides, plasticizers and the like. Any desired additives may be selected from conventional known compounds as needed.

Other components contained in the ink receiving layer are not limited, and any components which can receive aqueous ink and which exhibit solubility or compatibility with aqueous ink can be used within a range which does not hinder the achievement of the object of the present invention. Examples of other components include polyvinyl alcohol, polyurethane, carboxymethylcellulose, polyester, polyacrylic acid (ester), hydroxyethylcellulose, melamine resins, and modified products thereof, natural resins such as albumin, gelatin, casein, starch, cationic starch, gum arabic, sodium alginate and the like. However, the other components are not limited to these components. These components can be used in combination.

As the substrate of the recording medium, paper such as wood free paper, medium duty paper, art paper, bond paper, regenerated paper, baryta paper, cast coated paper, corrugated paper, resin coated paper, and the like; films or plates of plastics such as polyethylene terephthalate, diacetate, triacetate, cellophane, celluloid, polycarbonate, polyimide, polyvinyl chloride, polyvinylidene chloride, polyacrylate, polyethylene, polypropylene and the like, and glass plates can be used. As a matter of course, the substrate is not limited to these materials.

The substrate may have a smooth surface or an uneven surface, and may be transparent, translucent or opaque. A matte layer and a release adhesive may be provided on a side of the substrate opposite the printing surface.

An adhesive layer may further be provided on the printing surface after printing.

The substrate is appropriately selected from the foregoing substrates in accordance with the purpose of recording on the recording medium, the use of the recorded image, and various conditions such as adhesion to a composition coated thereon.

In production of the recording medium of the present invention, the above mentioned composition and, if required, other additives are dissolved or dispersed in water, alcohol, polyhydric alcohol, or another appropriate organic solvent to prepare a coating solution.

The thus-obtained coating solution is coated on the surface of the substrate by, for example, a roll coater method, a blade coater method, an air knife coater method, a gate roll coater method, a bar coater method, a size press method, a spray coating method, a gravure coater method, a curtain coater method or the like. The substrate is then dried by using, for example, a hot air drying oven or heating drum to obtain a recording medium of the present invention. The recording medium may further be supercalendered in order to smooth the ink receiving layer or increase the surface strength thereof.

The total coating weight of the ink receiving layer is within the range of 0.2 to 50 g/m$^2$, preferably 1 to 30 g/m$^2$, and more preferably 5 to 20 g/m$^2$. When the coating weight is less than 0.2 g/m$^2$, there is no noticeable improvement in the coloring properties of a dye, ink absorption capacity and ink fixing properties, as compared with a situation where no ink receiving layer is provided. On the other hand, with a coating weight exceeding 50 g/m$^2$, curling significantly occurs in an environment of low temperature and low humidity. When the coating weight is expressed in terms of thickness, the thickness is preferably within the range of 0.5 to 50 μm, more preferably within the range of 2.5 to 30 μm.

A known ink can be used for ink jet recording on the abovementioned recording medium.

Water soluble dyes such as direct dyes, basic dyes, reactive dyes and food dyes, disperse dyes and pigments can be used as recording agents.

Such water-soluble dyes, disperse dyes or pigments are generally used for conventional ink at a ratio of about 0.1 to 20% by weight, and thus may be used at this ratio in the present invention.

The solvent used for an aqueous ink in the present invention is water or a mixed solvent containing water and a water soluble organic solvent. A mixed solvent containing water and a water soluble organic solvent is particularly preferable, and a polyhydric alcohol having the effect of preventing ink drying is preferably contained as a water soluble organic solvent.

A preferable method of recording on the recording medium by applying an ink thereto is an ink jet recording method which may use a system in which an ink can effectively be released from a nozzle and applied to the recording medium.

Particularly, the ink jet system disclosed in Japanese Patent Laid-Open No. 54-59936, in which an ink rapidly changes in volume due to the action of thermal energy and is ejected from a nozzle by the action of this change of state, can effectively be used.

EXAMPLES

The present invention is described in further detail below with reference to examples. In the description below, "parts" or "%" means "parts by weight" or "% by weight" unless stated otherwise.

Examples 1 to 29, Comparative Examples 1 to 12

The types of the polyvinyl acetal resins and the alumina hydrates mixed and the mixing ratios are shown in Tables 1 and 2.

Examples 30 and 31

Recording media were prepared by the same method as Example 13 except that the coating thicknesses were 5 μm and 20 μm, and were evaluated by the same method. The results obtained are shown in Table 3.

The coating solutions prepared by mixing the components shown in Tables 1 and 2 were respectively coated on the substrates used in the Examples and Comparative Examples so that the coating thickness after drying was 10 μm, and then were dried at 120° C. for 5 minutes to prepare recording media of the present invention and comparative recording media. In each of the Examples and Comparative Examples, the coating solution was prepared under the following conditions.

Examples 1 to 3: An aqueous solution having a solids content of 15%.

Examples 4 to 31 and Comparative Examples 1 to 6: An aqueous solution containing water and isopropyl alcohol at a ratio of 60:40 and having a solids content of 8%.

Comparative Examples 7 and 12: an aqueous solution having a solids content of 19.8%.

Comparative Example 8: An aqueous solution containing water and isopropyl alcohol at a ratio of 60:40 and having a solids content of 7.9%.

Comparative Examples 9 to 11: An aqueous solution having a solids content of 10%.

Recording on each of the recording media was performed by a method using Bubble Jet Color Printer BIC-600 (trade name) produced by Canon. OHP sheet mode was used as the printing mode.

The substrates used are as follows.

Transparent PET: A4100 (without an adhesive layer) produced by Toyobo Co., Ltd.

White PET: Merinex 339 (100 μm) produced by I.C.I. Co., Ltd.

Cast paper: Broad Cast produced by Gojyoseishi Co., Ltd.

Resin coated paper: RC Gloria Manila produced by Gojyoseishi Co., Ltd.

Hologram sheet: Sample No. 705 produced by Gojyoseishi Co., Ltd.

Aluminum deposited paper: Transter GT-5 produced by Gojyoseishi Co., Ltd.

White tile: White tile produced by Mioh Clay Co., Ltd.

The resultant color print samples were evaluated with respect to the criteria below. The evaluation results obtained are shown in Tables 3, 4 and 5.

The transparent substrate was evaluated from the image projected by using Transmission type projector M4000 (produced by Sumitomo 3M Co., Ltd.).

TABLE 1

| | | i) Acetal Resin | | | | | | |
|---|---|---|---|---|---|---|---|---|
| | | PVA | | | | Degree of | | |
| | Substrate | Degree of Polymerization | Degree of Saponification | Remarks | Aldehyde | acetalization mol % | ii) Alumina Hydrate | i)/ii) |
| Example 1 | Transparent PET | 1700 | 88.0 | Unmodified | n-Butyl aldehyde | 5 | AS-2 (produced by Shokubai Kasei) | 20/1 |
| Example 2 | Transparent PET | 1700 | 88.0 | Unmodified | n-Butyl aldehyde | 12 | AS-2 (produced by Shokubai Kasei) | 20/1 |
| Example 3 | Transparent PET | 1700 | 88.0 | Unmodified | n-Butyl aldehyde | 18 | AS-2 (produced by Shokubai Kasei) | 20/1 |
| Example 4 | Transparent PET | 1000 | 88.0 | Unmodified | Phenyl acetaldehyde | 5 | AS-3 (produced by Shokubai Kasei) | 20/1 |
| Example 5 | Transparent PET | 1000 | 88.0 | Unmodified | Phenyl acetaldehyde | 12 | AS-3 (produced by Shokubai Kasei) | 20/1 |
| Example 6 | Transparent PET | 1000 | 88.0 | Unmodified | Phenyl acetaldehyde | 18 | AS-3 (produced by Shokubai Kasei) | 20/1 |
| Example 7 | Transparent PET | 1700 | 88.0 | Cation modified | Benzaldehyde | 5 | AS-100 (produced by Nissan Chemical Industries, Ltd.) | 10/1 |
| Example 8 | Transparent PET | 1700 | 88.0 | Cation modified | Benzaldehyde | 12 | AS-100 (produced by Nissan Chemical Industries, Ltd.) | 20/1 |
| Example 9 | Transparent PET | 1700 | 88.0 | Cation modified | Benzaldehyde | 18 | AS-100 (produced by Nissan Chemical Industries, Ltd.) | 10/1 |
| Example 10 | Transparent PET | 2000 | 88.0 | Unmodified | Benzaldehyde | 8 | AS-520 (produced by Nissan Chemical Industries, Ltd.) | 30/1 |
| Example 11 | Transparent PET | 2000 | 88.0 | Unmodified | Benzaldehyde | 8 | AS-520 (produced by Nissan Chemical Industries, Ltd.) | 40/1 |
| Example 12 | Transparent PET | 2000 | 88.0 | Unmodified | Benzaldehyde | 8 | AS-520 (produced by Nissan Chemical Industries, Ltd.) | 50/1 |
| Example 13 | Transparent PET | 2000 | 88.0 | Unmodified | Benzaldehyde | 8 | AS-520 (produced by Nissan Chemical Industries, Ltd.) | 10/1 |
| Example 14 | Transparent PET | 2000 | 88.0 | Unmodified | Benzaldehyde | 8 | AS-520 (produced by Nissan Chemical Industries, Ltd.) | 4/1 |
| Example 15 | Transparent PET | 2000 | 88.0 | Unmodified | Benzaldehyde | 8 | AS-520 (produced by Nissan Chemical Industries, Ltd.) | 7/3 |
| Example 16 | Transparent PET | 2000 | 88.0 | Unmodified | Benzaldehyde | 8 | AS-520 (produced by Nissan Chemical Industries, Ltd.) | 3/2 |
| Example 17 | Transparent PET | 2000 | 88.0 | Unmodified | Benzaldehyde | 8 | AS-2 (produced by Shokubai Kasei) | 10/1 |
| Example 18 | Transparent PET | 2000 | 88.0 | Unmodified | Benzaldehyde | 8 | AS-3 (produced by Shokubai Kasei) | 10/1 |
| Example 19 | Transparent PET | 2400 | 88.0 | Unmodified | Benzaldehyde | 8 | AS-520 (produced by Nissan Chemical Industries, Ltd.) | 10/1 |
| Example 20 | Transparent PET | 500 | 81.5 | Unmodified | Benzaldehyde | 12 | AS-520 (produced by Nissan Chemical Industries, Ltd.) | 10/1 |
| Example 21 | Transparent PET | 500 | 81.5 | Unmodified | Benzaldehyde | 20 | AS-520 (produced by Nissan | 10/1 |

TABLE 1-continued

| | Substrate | i) Acetal Resin: PVA: Degree of Polymerization | PVA: Degree of Saponification | PVA: Remarks | Aldehyde | Degree of acetalization mol % | ii) Alumina Hydrate | i)/ii) |
|---|---|---|---|---|---|---|---|---|
| | | | | | | | Chemical Industries, Ltd.) | |
| Example 22 | Transparent PET | 2000 | 79.5 | Unmodified | Benzaldehyde | 8 | AS-520 (produced by Nissan Chemical Industries, Ltd.) | 10/1 |
| Example 23 | Transparent PET | 3500 | 88.0 | Unmodified | Benzaldehyde | 8 | AS-520 (produced by Nissan Chemical Industries, Ltd.) | 10/1 |
| Example 24 | White PET | 2000 | 88.0 | Unmodified | Benzaldehyde | 8 | AS-520 (produced by Nissan Chemical Industries, Ltd.) | 10/1 |
| Example 25 | Resin coated paper | 2000 | 88.0 | Unmodified | Benzaldehyde | 8 | AS-520 (produced by Nissan Chemical Industries, Ltd.) | 10/1 |
| Example 26 | Cast paper | 2000 | 88.0 | Unmodified | Benzaldehyde | 8 | AS-520 (produced by Nissan Chemical Industries, Ltd.) | 10/1 |
| Example 27 | White tile | 2000 | 88.0 | Unmodified | Benzaldehyde | 8 | AS-520 (produced by Nissan Chemical Industries, Ltd.) | 10/1 |
| Example 28 | Hologram sheet | 2000 | 88.0 | Unmodified | Benzaldehyde | 8 | AS-520 (produced by Nissan Chemical Industries, Ltd.) | 10/1 |
| Example 29 | Aluminum deposited paper | 2000 | 88.0 | Unmodified | Benzaldehyde | 8 | AS-520 (produced by Nissan Chemical Industries, Ltd.) | 10/1 |

TABLE 2

| | Substrate | i) Acetal Resin: PVA: Degree of Polymerization | PVA: Degree of Saponification | PVA: Remarks | Aldehyde | Degree of acetalization mol % | ii) Alumina Hydrate | i)/ii) |
|---|---|---|---|---|---|---|---|---|
| Comparative Example 1 | Transparent PET | 2000 | 88.0 | Unmodified | Benzaldehyde | 8 | AS-520 (Nissan Chemical Industries, Ltd.) | 60/1 |
| Comparative Example 2 | Transparent PET | 2000 | 88.0 | Unmodified | Benzaldehyde | 8 | AS-520 (Nissan Chemical Industries, Ltd.) | 80/1 |
| Comparative Example 3 | Transparent PET | 2000 | 88.0 | Unmodified | Benzaldehyde | 8 | AS-520 (Nissan Chemical Industries, Ltd.) | 100/1 |
| Comparative Example 4 | Transparent PET | 2000 | 88.0 | Unmodified | Benzaldehyde | 8 | AS-520 (Nissan Chemical Industries, Ltd.) | 1/1 |
| Comparative Example 5 | Transparent PET | 2000 | 88.0 | Unmodified | Benzaldehyde | 8 | AS-520 (Nissan Chemical Industries, Ltd.) | 1/100 |
| Comparative Example 6 | Transparent PET | 2000 | 88.0 | Unmodified | Benzaldehyde | 8 | None | — |
| Comparative Example 7 | Transparent PET | KW-1 produced by Sekisui Kagaku | | | | | None | — |
| Comparative Example 8 | Transparent PET | KX-1 produced by Sekisui Kagaku | | | | | None | — |
| Comparative Example 9 | Transparent PET | 1700 | 88.0 | Unmodified | | None | AS-520 (Nissan Chemical Industries, Ltd.) | 10/1 |
| Comparative Example 10 | Transparent PET | K-90 produced by GAF Co. | | | | None | AS-520 (Nissan Chemical Industries, Ltd.) | 10/1 |
| Comparative Example 11 | Transparent PET | AL-15 produced by Fuji Chemical | | | | None | AS-520 (Nissan Chemical Industries, Ltd.) | 10/1 |
| Comparative Example 12 | White PET | KW-1 produced by Sekusui Kagaku | | | | | None | — |

Evaluation Items (1) Transparency

Transparency was measured by Direct Read Haze Meter (produced by Toyoseiki) at five points, and five measurements were averaged. Only the samples comprising the transparent substrate were measured.

(2) Resistance to fingerprint marks

After sweaty fingertips were pressed on a recording surface, the surface was wiped with a cloth consisting of 100% cotton, and then visually observed.

The resistance to fingerprint marks was judged on the basis of the following criteria:

o: Fingerprint marks could be completely wiped off.

x: Fingerprint marks could not be completely wiped off.

Δ: Impossible to evaluate.

(3) Ink fixing properties

An image was recorded by full dots (the amount of ink applied: 16 to 20 ng/mm$^2$) using two of yellow, cyan and magenta colors in an environment of 30° C. and 80% RH, and then was allowed to stand. A decision was made on the basis of the following criteria as to whether or not an ink was entrapped in the ink receiving layer so as not to adhere to the fingers when the recorded image was touched.

o: Ink did not adhere to the fingers after a lapse of 5 minutes or less.

Δ: ink did not adhere to the fingers after a lapse of 10 minutes or less.

x: Ink adhered to the fingers even after a lapse of 10 minutes.

(4) Ink absorption capacity

An image was recorded by full dots using three or two of yellow, cyan and magenta colors in an environment of 30° C. and 80% RH, and then evaluated on the basis of the following criteria:

◎: In full dot recording using three colors, a solid recorded portion was uniform and had no feathering at boundaries between different colors regardless of the recording density;

o: In full dot recording using two colors, a solid recorded portion was uniform and had no feathering at boundaries between different colors regardless of the recording density;

x: Other results were obtained.

The recorded image comprised a full dot recorded portion having three or two of yellow, cyan and magenta colors, and yellow recorded portions provided at both sides of the full dot recorded portion.

(5) Water resistance

One hour after recording, a recording medium was immersed in water contained in a tray for 10 seconds, and pulled out. After water was wiped off with a cloth of 100% cotton, water resistance was evaluated by visual observation.

The recorded image comprised squares (3 cm×3 cm) of black, cyan, magenta, yellow, red, green and blue.

Evaluation was made on the basis of the following criteria:

o: The image hardly deteriorated.

Δ: The inks flowed out, but the image was confirmed to be the same as the image before the water resistance test.

x: The ink receiving layer dissolved in water; or the ink receiving layer did not dissolve in water, but the image was significantly different from the image before the water resistance test.

(6) image quality

An image comprising lateral stripes (2 cm×15 cm/1 line) of black, cyan, magenta, yellow, red, green and blue was recorded. Image quality was evaluated by visual observation on the basis of the following criteria:

o: In visual observation, the recorded image had excellent uniformity in a solid printed portion without color nonuniformity due to beading and feathering at boundaries between different colors.

x: The recorded image had poor uniformity in a solid printed portion with color nonuniformity due to beading and feathering at boundaries between different colors, and the image quality was significantly bad.

Δ: Intermediate to o and x (7) Storage properties of recording medium

A recording medium was stored in an environment of 35° C. and 90% RH for 7 days, and then in an environment of 23° C. and 55% RH for 1 day, and then was evaluated by using the above-described printer in an environment of 23° C. and 55% RH.

The recorded image comprised black characters "ABCDE" (Font: Times, Size: 18 point) on a yellow ground.

Evaluation was made on the basis of the following criteria:

x: Ink overflow, bleeding and thickening of the characters occurred, and image quality thus significantly deteriorated, as compared with the image quality before storage.

o: No change was observed.

Δ: Intermediate to x and o.

xx: Problems of decreased image density and clouding of the film (decreased transparency), other than the problem of decreased ink absorption, occurred.

(8) Image storage properties

An image was recorded on each of the recording media by using the above printer, stored in an environment of 35° C. and 90% RH for 7 days, and then was compared with the image before storage.

The recorded image comprised black characters "ABCDE" (Font: Times, Size: 18 point) on a yellow ground.

Image storage properties were evaluated on the basis of the following criteria:

x: Ink overflow, bleeding and thickening of the characters occurred, and image quality thus significantly deteriorated, as compared with the image quality before storage.

o: No change was observed.

Δ: Intermediate to x and o.

(9) Glossiness

Mirror glossiness was measured at five points on each of a printed portion and an unprinted portion at angles of 20° and 70° by using Digital variable angle glossimeter UVG-5D (produced by Suga Shikenki Co., Ltd.), and the five measurements were averaged.

(Substrates other than a transparent substrate)

The recorded image comprised squares (3 cm×3 cm) of black, cyan, magenta, yellow, red, green and blue.

(10) Adhesion between the ink receiving layer and the substrate

A vinyl tape (No. 21 produced by Nittodenko, 19 mm in width) was bonded to the recording surface, and then peeled off. Adhesion was evaluated on the basis of the following criteria:

o: No problem occurred in the ink receiving layer.

x: The ink receiving layer was peeled off.

TABLE 3

| | | Evaluation Items | | | | | | | |
|---|---|---|---|---|---|---|---|---|---|
| | Haze (%) | Resistance to Fingerprint Marks | Ink Fixing Properties | Ink Absorption | Water Resistance | Image Quality | Storage Properties of Recording Medium | Image Storage Properties | Adhesion |
| Example 1 | 2.7 | o | o | ◎ | Δ | o | o | o | o |
| Example 2 | 2.3 | o | o | ◎ | Δ | o | o | o | o |
| Example 3 | 2.3 | o | o | ◎ | Δ | o | o | o | o |
| Example 4 | 2.9 | o | o | ◎ | o | o | o | o | o |
| Example 5 | 2.4 | o | o | ◎ | o | o | o | o | o |
| Example 6 | 2.2 | o | o | ◎ | o | o | o | o | o |
| Example 7 | 3.0 | o | o | ◎ | Δ | o | o | Δ | o |
| Example 8 | 3.1 | o | o | ◎ | Δ | o | o | Δ | o |
| Example 9 | 3.4 | o | o | ◎ | Δ | o | o | Δ | o |
| Example 10 | 2.0 | o | o | ◎ | o | o | o | o | o |
| Example 11 | 1.8 | o | Δ | ◎ | o | o | o | Δ | o |
| Example 12 | 2.2 | o | Δ | ◎ | o | o | o | Δ | o |

TABLE 3-continued

| | Haze (%) | Evaluation Items | | | | | | | |
|---|---|---|---|---|---|---|---|---|---|
| | | Resistance to Fingerprint Marks | Ink Fixing Properties | Ink Absorption | Water Resistance | Image Quality | Storage Properties of Recording Medium | Image Storage Properties | Adhesion |
| Example 13 | 2.1 | ○ | ○ | ◎ | ○ | ○ | ○ | ○ | ○ |
| Example 14 | 2.6 | ○ | ○ | ◎ | ○ | ○ | ○ | ○ | ○ |
| Example 15 | 3.6 | ○ | Δ | ○ | ○ | ○ | ○ | ○ | ○ |
| Example 16 | 4.2 | ○ | Δ | ○ | ○ | Δ | ○ | ○ | ○ |
| Example 17 | 2.6 | ○ | ○ | ◎ | ○ | ○ | ○ | ○ | ○ |
| Example 18 | 2.5 | ○ | ○ | ◎ | ○ | ○ | ○ | ○ | ○ |
| Example 19 | 2.8 | ○ | ○ | ◎ | ○ | ○ | ○ | ○ | ○ |
| Example 20 | 2.4 | ○ | ○ | ◎ | ○ | ○ | ○ | ○ | ○ |
| Example 21 | 2.1 | ○ | ○ | ◎ | ○ | ○ | ○ | ○ | ○ |
| Example 22 | 2.6 | ○ | ○ | ◎ | ○ | ○ | ○ | ○ | ○ |
| Example 23 | 2.3 | ○ | ○ | ◎ | ○ | ○ | ○ | ○ | ○ |
| Example 24 | — | ○ | ○ | ◎ | ○ | ○ | ○ | ○ | ○ |
| Example 25 | — | ○ | ○ | ◎ | ○ | ○ | ○ | ○ | ○ |
| Example 26 | — | ○ | ○ | ◎ | ○ | ○ | ○ | ○ | ○ |
| Example 27 | — | ○ | ○ | ◎ | ○ | ○ | ○ | ○ | ○ |
| Example 28 | — | ○ | ○ | ◎ | ○ | ○ | ○ | ○ | ○ |
| Example 29 | — | ○ | ○ | ◎ | ○ | ○ | ○ | ○ | ○ |
| Example 30 | 1.8 | ○ | Δ | ○ | ○ | Δ | ○ | Δ | ○ |
| Example 31 | 2.6 | ○ | ○ | ◎ | ○ | ○ | ○ | ○ | ○ |

TABLE 4

| | Haze (%) | Evaluation Items | | | | | | | |
|---|---|---|---|---|---|---|---|---|---|
| | | Resistance to Fingerprint Marks | Ink Fixing Properties | Ink Absorption | Water Resistance | Image Quality | Storage Properties of Recording Medium | Image Storage Properties | Adhesion |
| Comparative Example 1 | 3.2 | x | Δ | ○ | ○ | Δ | ○ | Δ | ○ |
| Comparative Example 2 | 3.1 | x | x | ○ | ○ | Δ | ○ | x | ○ |
| Comparative Example 3 | 2.9 | x | x | x | ○ | Δ | ○ | x | ○ |
| Comparative Example 4 | 4.5 | ○ | x | ○ | Δ | Δ | ○ | ○ | ○ |
| Comparative Example 5 | 7.2 | ○ | x | x | x | x | xx | Impossible to evaluate | x |
| Comparative Example 6 | 9.0 | x | Δ | ○ | Δ | Δ | ○ | x | ○ |
| Comparative Example 7 | 3.0 | x | Δ | ○ | x | ○ | ○ | x | ○ |
| Comparative Example 8 | 2.8 | x | Δ | ○ | ○ | Δ | ○ | x | ○ |
| Comparative Example 9 | 3.4 | x | x | ○ | x | ○ | Δ | Δ | x |
| Comparative Example 10 | 4.5 | x | ○ | ◎ | x | ○ | x | Δ | x |
| Comparative Example 11 | 4.2 | x | Δ | ○ | x | Δ | xx | Δ | x |
| Comparative Example 12 | — | x | Δ | ○ | x | ○ | ○ | x | ○ |

TABLE 5

| | Mirror Glossiness | | | | | | | | | |
|---|---|---|---|---|---|---|---|---|---|---|
| | Unprinted Portion | | Black Printed Portion | | Cyan Printed Portion | | Magenta Printed Portion | | Yellow Printed Portion | |
| | 20° | 75° | 20° | 75° | 20° | 75° | 20° | 75° | 20° | 75° |
| Example 24 | 67.2 | 95.7 | 58.6 | 95.3 | 66.5 | 99.8 | 49.6 | 93.5 | 61.8 | 98.0 |
| Example 25 | 77.7 | 94.8 | 64.3 | 94.5 | 66.6 | 97.2 | 59.5 | 97.0 | 66.7 | 98.1 |
| Example 26 | 72.3 | 92.5 | 62.5 | 93.5 | 60.3 | 93.1 | 57.6 | 94.9 | 61.1 | 94.8 |
| Example 27 | 70.8 | 94.5 | 64.3 | 94.9 | 68.6 | 99.4 | 53.2 | 94.2 | 63.5 | 94.9 |
| Example 28 | — | 254.3 | 72.6 | 99.8 | 254.7 | 131.5 | 176.5 | 128.5 | — | 192.7 |
| Example 29 | — | 300.2 | 80.6 | 95.4 | 347.4 | 136.1 | 242.9 | 135.6 | — | 200.3 |

TABLE 5-continued

| | Mirror Glossiness | | | | | | | | | |
|---|---|---|---|---|---|---|---|---|---|---|
| | Unprinted Portion | | Black Printed Portion | | Cyan Printed Portion | | Magenta Printed Portion | | Yellow Printed Portion | |
| | 20° | 75° | 20° | 75° | 20° | 75° | 20° | 75° | 20° | 75° |
| Comparative Example 12 | 45.2 | 81.4 | 30.6 | 83.1 | 343.3 | 82.1 | 34.3 | 81.2 | 31.3 | 80.4 |

Examples 32 to 45, Comparative Examples 13 to 17 and Reference Examples 1 to 3

The types and mixing ratios of polyvinyl acetal resins, alumina hydrates and cationic resins used are shown in Table 6.

The substrates used are as follows.

Transparent PET: A4100 produced by Toyobo Co., Ltd.

White PET: Merinex 339 (100 μm) produced by I.C.I. Co., Ltd.

The resultant color print samples were evaluated with respect to the items below. Results of the evaluations are shown in Table 7.

o: The projected image was light and had high optical density and contrast, and was thus clear and easy to see.

Δ: The projected image was dark and had low optical density.

x: The projected image was apparently dark and had extremely low optical density and no definition.

(2) Resistance to fingerprint marks

After sweaty fingertips were pressed on a recording surface, the recording surface was wiped with a Kim Wipe (Trade name, produced by Jujo Kimberly K.K.), and then visually observed. An evaluation was made on the basis of the following criteria:

o: Fingerprint marks were completely wiped off.

x: Fingerprint marks were not completely wiped off.

TABLE 6

| | | Polyvinyl acetal resin (A) | | | | | | | | |
|---|---|---|---|---|---|---|---|---|---|---|
| | Sbustrate | PVA[1] | Aldehyde[2] | Degree of acetalization (mol %) | Hydroxyl group (mol %) | Alumina hydrate (B)[3] | A/B | Cationic resin (C)[4] (Molecular weight) | A/C | Recording agent[5] |
| Example 32 | Transparent PET | PVA220 | BA | 12 | 40 | AS-100 | 20/1 | PAA-HCL-1L(1000) | 50/1 | AN |
| Example 33 | Transparent PET | PVA220 | BA | 3 | 40 | AS-100 | 20/1 | PAA-HCL-1L(1000) | 50/1 | AN |
| Example 34 | Transparent PET | PVA220 | BA | 20 | 40 | AS-100 | 20/1 | PAA-HCL-1L(1000) | 50/1 | AN |
| Example 35 | Transparent PET | PVA220 | BA | 12 | 10 | AS-100 | 20/1 | PAA-HCL-1L(1000) | 50/1 | AN |
| Example 36 | Transparent PET | PVA220 | BA | 12 | 60 | AS-100 | 20/1 | PAA-HCL-1L(1000) | 50/1 | AN |
| Example 37 | Transparent PET | PVA220 | BA | 12 | 40 | AS-100 | 50/1 | PAA-HCL-1L(1000) | 50/1 | AN |
| Example 38 | Transparent PET | PVA220 | BA | 12 | 40 | AS-100 | 3/2 | PAA-HCL-1L(1000) | 50/1 | AN |
| Example 39 | Transparent PET | PVA220 | BA | 12 | 40 | AS-100 | 20/1 | PAA-HCL-1L(1000) | 190/1 | AN |
| Example 40 | Transparent PET | PVA220 | BA | 12 | 40 | AS-100 | 20/1 | PAA-HCL-1L(1000) | 19/1 | AN |
| Example 41 | Transparent PET | PVA220 | BA | 12 | 40 | AS-100 | 20/1 | PAA-HCL-1L(1000) | 50/1 | CA |
| Example 42 | Transparent PET | PVA220 | BA | 12 | 40 | AS-100 | 20/1 | PAS-H-5L(50000) | 50/1 | AN |
| Example 43 | Transparent PET | PVA217 | n-BuA | 12 | 40 | AS-2 | 20/1 | PAA-HCL-1L(1000) | 50/1 | AN |
| Example 44 | Transparent PET | PVA210 | PhAcA | 12 | 40 | AS-3 | 20/1 | PAA-HCL-3L(10000) | 50/1 | AN |
| Example 45 | White PET | PVA220 | BA | 10 | 30 | AS-100 | 10/1 | PAA-HCL-1L(1000) | 70/1 | AN |
| Comparative Example 13 | Transparent PET | PVA220 | BA | 12 | 40 | AS-100 | 60/1 | PAA-HCL-1L(1000) | 50/1 | AN |
| Comparative Example 14 | Transparent PET | PVA220 | BA | 12 | 40 | None | — | PAA-HCL-1L(1000) | 50/1 | AN |
| Comparative Example 15 | Transparent PET | PVA220 | BA | 12 | 40 | AS-100 | 1/1 | PAA-HCL-1L(1000) | 50/1 | AN |
| Comparative Example 16 | Transparent PET | PVA220 | None | — | — | AS-100 | 20/1 | PAA-HCL-1L(1000) | 50/1 | AN |
| Reference Example 1 | Transparent PET | PVA220 | BA | 12 | 40 | AS-100 | 20/1 | PAA-HCL-1L(1000) | 200/1 | AN |
| Reference Example 2 | Transparent PET | PVA220 | BA | 12 | 40 | AS-100 | 20/1 | None | | AN |
| Reference Example 3 | Transparent PET | PVA220 | BA | 12 | 40 | AS-100 | 20/1 | PAA-HCL-1L(1000) | 17/1 | AN |
| Comparative Example 17 | Transparent PET | Produced by Sekisui Kagaku KS-1 | | | | AS-100 | 20/1 | PAA-HCL-1L(1000) | 50/1 | AN |

The transparent substrate was evaluated by projecting an image using Transmission type projector M4000 (produced by Sumitomo 3M Co., Ltd.).

Evaluation Items (1) Transparency

The recorded image was projected by OHP, and transparency was evaluated by visual observation on the basis of the following criteria:

Δ: Intermediate to o and x.

(3) ink fixing properties

After an image was recorded with full dots (the amount of ink applied being 16 to 20 ng/mm$^2$) of two of yellow, cyan and magenta colors in an environment of 30° C. and 80% RH and allowed to stand, the image was touched with fingers. A decision was made on the basis of the following criteria as to whether the ink was entrapped in the ink receiving layer so as not to adhere to the fingers:

o: No ink adhered to the fingers after a lapse of 5 minutes or less.

Δ: No ink adhered to the fingers after a lapse of 10 minutes or less.

x: The ink adhered to the fingers even after a lapse of 10 minutes.

(4) Ink absorption capacity (measured at room temperature)

An evaluation was made on the basis of the following criteria:

o: A solid printed portion was clean up to 300% printing regardless of duty.

Δ: A solid printed portion was clean up to 200% printing regardless of duty.

x: A solid printed portion was clean up to only 100% printing.

(5) Water resistance

One hour after recording, a recorded medium was immersed in water contained in a tray, and then pulled out, and then the water was wiped off with a Kim Towel (trade name, produced by Jujo Kimberly K.K.). An evaluation was made by visual observation on the basis of the following criteria:

o: No change was observed in the image.

Δ: Ink outflow or dissolution of the ink receiving layer occurred slightly, but significant deterioration was not observed in the image.

x: The ink receiving layer was dissolved, or the ink receiving layer was not dissolved, but the image was significantly different from the image before the water resistance test.

(6) Image quality

An image comprising lateral stripes (2 cm×15 cm/1 line) of black, cyan, magenta, yellow, red, green and blue was recorded. Uniformity in a solid printed portion, and feathering at boundaries between different colors were evaluated by visual observation on the basis of the following criteria:

o: No problem was observed.

x: Image quality was significantly poor.

Δ: intermediate to o and x.

(7) Storage properties of recording medium

After the recording medium was stored in an environment of 35° C. and 90% RH for 7 days, the recording medium was stored in an environment of 23° C. and 55% RH for 1 day. A solid image comprising a black square on a yellow ground was printed and then evaluated in an environment of 23° C. and 55% RH by using the above-described printer on the basis of the following criteria:

o: No change was observed.

x: Outflow of ink, bleeding and thickening of the characters occurred, and image quality was significantly poor, as compared with the image before storage.

Δ: Intermediate to o and x.

(8) Image storage properties

The image recorded on a recording medium by using the above printer was stored in an environment of 35° C. and 95% RH for 10 days, and then evaluated by comparing with the image before storage on the basis of the following criteria:

o: No change was observed.

x: Outflow of ink, bleeding and thickening of characters occurred, and image quality was significantly poor, as compared with the image before storage.

Δ: Intermediate to o and x.

(9) Adhesion between the ink receiving layer and the substrate

A vinyl tape (No. 21 produced by Nittodenko, 19 mm in width) was bonded to the recording surface, and then peeled off. Adhesion was evaluated on the basis of the following criteria:

o: No problem occurred in the ink receiving layer.

Δ: Only the recorded portion was slightly easily peeled off.

x: The ink receiving layer was peeled off.

TABLE 7

| | Transparency | Resistance to fingerprint marks | Ink fixing properties | Ink absorption capacity | Water resistance | Image quality | Storage properties of recording medium | Image storage properties | Adhesion |
|---|---|---|---|---|---|---|---|---|---|
| Example 32 | o | o | o | o | o | o | o | o | o |
| Example 33 | o | o | o | o | o | o | o | o | o |
| Example 34 | o | o | o | o | o | o | o | o | o |
| Example 35 | o | o | o | o | o | o | o | o | Δ |
| Example 36 | o | o | o | o | Δ | o | o | o | o |
| Example 37 | o | o | Δ | o | o | o | o | o | o |
| Example 38 | Δ | o | Δ | Δ | o | Δ | o | o | o |
| Example 39 | o | o | o | o | o | o | o | o | o |
| Example 40 | o | o | o | o | o | o | o | o | o |
| Example 41 | o | o | o | o | Δ | o | o | Δ | o |
| Example 42 | o | o | o | o | o | o | o | o | o |
| Example 43 | o | o | o | o | Δ | o | o | o | o |
| Example 44 | o | o | o | o | o | o | o | o | o |
| Example 45 | o | o | o | o | o | o | o | o | o |
| Comparative Example 13 | o | Δ | Δ | Δ | o | Δ | o | o | o |
| Comparative Example 14 | o | Δ | Δ | Δ | Δ | Δ | o | Δ | o |
| Comparative Example 15 | x | o | x | Δ | o | Δ | o | o | o |
| Comparative Example 16 | o | x | x | Δ | x | o | Δ | Δ | x |
| Reference Example 1 | o | o | o | o | Δ | o | o | Δ | o |
| Reference | o | o | o | o | Δ | o | o | Δ | o |

TABLE 7-continued

| | Trans-parency | Resistance to fingerprint marks | Ink fixing properties | Ink absorption capacity | Water resistance | Image quality | Storage properties of recording medium | Image storage properties | Adhesion |
|---|---|---|---|---|---|---|---|---|---|
| Example 2 Reference Example 3 | ○ | ○ | Δ | Δ | ○ | Δ | ○ | ○ | ○ |
| Comparative Example 17 | ○ | ○ | x | x | ○ | x | ○ | ○ | ○ |

As described above, the present invention provides a recording medium which exhibits excellent ink absorption and high ink absorption capacity, which is capable of forming an image having clear dots, a high optical density and high definition, which causes no deterioration in the recording medium itself or the image recorded thereon in an environment of high temperature and high humidity, and which has high resistance to fingerprint marks. The recording medium comprises an ink receiving layer and a recording portion which have water resistance. When a transparent substrate is used, the recording medium has excellent transparency, and when a white substrate is used, both the printed and unprinted portions have high glossiness. The recording medium also exhibits excellent adhesion between the ink receiving layer and the substrate.

What is claimed is:

1. A recording medium comprising a substrate and an ink receiving layer provided on at least one side of the substrate, wherein the ink receiving layer contains polyvinyl acetal resin and alumina hydrate at a ratio by weight within a range of 50/1 to 6/4.

2. A recording medium according to claim 1, wherein the content ratio of polyvinyl acetal resin to alumina hydrate is within a range of 30/1 to 7/3.

3. A recording medium according to claim 1, wherein the polyvinyl acetal resin is an aromatic polyvinyl acetal resin.

4. A recording medium according to claim 1, wherein the polyvinyl acetal resin has a degree of acetalization within a range of 0.5 to 40 mol %.

5. A recording medium according to claim 4, wherein the degree of acetalization of the polyvinyl acetal resin is within a range of 3 to 25 mol %.

6. A recording medium according to claim 4, wherein the degree of acetalization of the polyvinyl acetal resin is within a range of 5 to 20 mol %.

7. A recording medium according to claim 1, wherein the alumina hydrate is selected from the group consisting of boehmite, pseudoboehmite and amorphous alumina hydrate.

8. A recording medium according to claim 1, wherein the alumina hydrate has a particle size within a range of 1.0 to 80.0 nm.

9. A recording medium according to claim 1, wherein the substrate is a plastic film.

10. A recording medium according to claim 1, wherein the substrate is transparent and has a haze of not more than 10%.

11. A recording medium according to claim 1, wherein the ink receiving layer has a thickness within a range of 0.5 to 50 μm.

12. A recording medium according to claim 1, wherein the ink receiving layer has a thickness within a range of 2.5 to 30 μm.

13. A recording medium according to claim 1, wherein the ink receiving layer further contains a cationic compound.

14. A recording medium according to claim 13, wherein the cationic compound is a cationic resin.

15. A recording medium according to claim 13, wherein the polyvinyl acetal resin and the cationic compound are mixed at a ratio by weight within a range of 190/1 to 19/1.

16. A recording medium according to claim 14, wherein the cationic resin has a weight average molecular weight within a range of 500 to 50000.

17. An image forming method comprising applying an ink to the recording medium of any one of claims 1 to 16 by an ink jet recording method.

18. An image forming method according to claim 17, wherein the ink is an aqueous ink.

19. An image forming method according to claim 17, wherein the ink jet recording method is a method in which ink is ejected by the action of thermal energy.

20. A printed product obtained by forming an image on the recording material of any one of claims 1 to 16.

* * * * *

UNITED STATES PATENT AND TRADEMARK OFFICE

CERTIFICATE OF CORRECTION

PATENT NO. : 5,733,637
DATED : March 31, 1998
INVENTOR(S) : KENICHI MORIYA, ET AL.

It is certified that error appears in the above-identified patent and that said Letters Patent is hereby corrected as shown below:

Column 7

Line 2, "20" should be deleted.

Column 17

Table 5, Line 9, "343.3" should read --34.3--;
Table 6, Line 33, "Sbustrate" should read --substrate--; and
Example 44, Line 49, "40" should read --50--.

Column 18

Line 61, "ink" should read --Ink--.

Column 20

Line 3, "intermediate" should read --Intermediate--.

Signed and Sealed this
Ninth Day of February, 1999

*Attest:*

*Attesting Officer*

*Acting Commissioner of Patents and Trademarks*